US006367559B1

(12) United States Patent
Winebrenner

(10) Patent No.: US 6,367,559 B1
(45) Date of Patent: Apr. 9, 2002

(54) DOUBLE-BLADE DEFLECTOR FOR SIDE WALL SPRINKLER

(75) Inventor: Thomas E. Winebrenner, Hastings, MI (US)

(73) Assignee: The Viking Corporation, Hastings, MI (US)

( * ) Notice: Subject to any disclaimer, the term of this patent is extended or adjusted under 35 U.S.C. 154(b) by 0 days.

(21) Appl. No.: 09/438,141

(22) Filed: Nov. 10, 1999

Related U.S. Application Data

(60) Provisional application No. 60/114,350, filed on Dec. 29, 1998.

(51) Int. Cl.[7] ..... A62C 37/08

(52) U.S. Cl. ..... 169/37; 169/41; 169/42; 169/57; 239/502; 239/504; 239/509; 239/521; 239/522; 239/524

(58) Field of Search ..... 169/37, 41, 42, 169/57; 239/498, 502, 504, 509, 518, 521, 522, 523, 524

(56) References Cited

U.S. PATENT DOCUMENTS

| | | | | |
|---|---|---|---|---|
| 3,459,266 A | * | 8/1969 | Ault | 169/41 X |
| 3,714,989 A | * | 2/1973 | Gloeckler | 169/42 X |
| 3,880,239 A | | 4/1975 | Vorkapich | 169/37 |

(List continued on next page.)

OTHER PUBLICATIONS

Micromatic® Model M–5 Horizontal Sidewall Sprinkler, The Viking Engineering and Design Data, The Viking Corporation, May 16, 1997, Sprinkler 14e–g.

Model M Fusible Link Sidewall Sprinkler, The Viking Engineering and Design Data, The Viking Corporation, Apr. 9, 1998, Sprinkler 19a–d.

MicromaticHP® Model M Sprinklers, The Viking Engineering and Design Data, The Viking Corporation, Mar. 3, 1997, Sprinkler 31a–d.

*Primary Examiner*—David A. Scherbel
*Assistant Examiner*—Robin O. Evans
(74) *Attorney, Agent, or Firm*—Van Dyke, Gardner, Linn & Burkhart, LLP

(57) ABSTRACT

An automatic flush sprinkler side wall sprinkler assembly includes a sprinkler body, a deflector, a closure member, and a trigger assembly. The deflector is movably mounted to the sprinkler body between a retracted position wherein at least a portion of the deflector is recessed within a cavity of the sprinkler head body and an extended position wherein the deflector is spaced from an outlet opening of the sprinkler head body for dispersing pressurized fluid which flows from the outlet opening. The deflector includes at least two horizontal deflecting surfaces which are positioned spaced from and generally parallel to a direction of flow of the fluid from the outlet opening for directing the flow of fluid outwardly and downwardly from the sprinkler assembly and, further, are provided on a common side and spaced from a central axis of the deflector. The closure member is positioned between the deflector and the outlet opening for sealing the outlet opening. The trigger assembly applies a biasing force to urge the deflector in the retracted position and to urge the closure member to sealingly engage the sprinkler body to thereby close the outlet opening. Upon detecting a temperature associated with a fire, the trigger assembly releases the biasing force on the deflector and the closure member whereby the pressurized fluid moves the closure member off the outlet opening and moves the deflector to the extended position. Preferably, the trigger assembly includes an ejector member which urges the trigger assembly to eject outwardly from the sprinkler head body to improve release of the trigger assembly from the sprinkler assembly.

30 Claims, 6 Drawing Sheets

U.S. PATENT DOCUMENTS

| | | | | | |
|---|---|---|---|---|---|
| 3,904,126 | A | | 9/1975 | Allard | 239/502 |
| 4,014,388 | A | | 3/1977 | Anderson | 169/37 |
| 4,066,129 | A | | 1/1978 | Anderson | 169/37 |
| 4,296,815 | A | | 10/1981 | Mears | 169/37 |
| 4,296,816 | A | | 10/1981 | Fischer | 169/37 |
| 4,830,117 | A | * | 5/1989 | Capasso | 169/57 X |
| 4,977,963 | A | * | 12/1990 | Simons | 169/42 X |
| 4,987,957 | A | | 1/1991 | Galaszewski | 169/37 |
| 5,020,601 | A | | 6/1991 | Retzloff et al. | 169/37 |
| 5,669,449 | A | | 9/1997 | Polan et al. | 169/16 |
| 5,722,599 | A | | 3/1998 | Fries | 239/504 |
| 5,727,737 | A | | 3/1998 | Bosio et al. | 239/504 |
| 6,098,718 | A | * | 8/2000 | Sato | 169/37 |
| 6,129,153 | A | * | 10/2000 | Joung | 169/37 |

* cited by examiner

DOUBLE-BLADE DEFLECTOR FOR SIDE WALL SPRINKLER

The present application claim priority from pending provisional U.S. patent application Ser. No. 60/114,350, filed Dec. 29, 1998, which is incorporated in its entirety by reference herein.

TECHNICAL FIELD AND BACKGROUND OF THE INVENTION

The present invention relates to a sprinkler assembly and, more particularly, to a flush sprinkler assembly for use in a side wall mount.

Automatic sprinklers are well known and have long been used in fire extinguishing systems. Typically, automatic sprinkler assemblies include a sprinkler head which includes an inlet for connecting to a pressurized supply of water or other fire extinguishing fluid, an outlet opening, and a deflector which is mounted spaced from the outlet opening of the sprinkler head. The deflector disperses and directs the water in an optimum pattern when the water is discharged through the outlet opening. In one common form, the deflector is mounted in a fixed position and spaced from the outlet opening by a frame. The frame includes a pair of arms, which attach to either side of the sprinkler head, and aligns the deflector with the path of the water when it is discharged through the outlet opening. The outlet opening is normally closed by a closure seal which is held in place typically by a trigger element, such as a glass bulb or a fusible link element. The trigger element extends between the seal and the frame and is usually held in place by a set screw or the like.

Other forms of sprinkler assemblies include flush sprinkler assemblies. Flush sprinkler assemblies include a housing and a deflector which is recessed within the housing. The deflector is movably mounted to the sprinkler head by a pair of guide members and moves between a closed position in which the deflector is recessed within the housing and an extended position wherein the deflector projects from the housing and is spaced from the outlet opening of the sprinkler head. Since the deflector is supported only by two guide members, the deflector can experience instability or rotation about the axis extending between the two guide members. Similar to a fixed sprinkler head assembly, a flush sprinkler head assembly includes a thermally responsive trigger mechanism and a fluid seal. In a flush sprinkler, the fluid seal is positioned within the interior of the sprinkler head and is maintained in a closed position by a pair of pins or actuators. The pins are inwardly biased by the trigger mechanism. Thus, under normal operating conditions, the trigger mechanism prohibits fluid flow from the outlet of sprinkler head. When the temperature rises to a preselected value, the trigger mechanism, which is normally a fusible link, separates permitting the pins to move in an outward direction under the pressure of the water. With the separation of the fusible link, the pressure in the water supply line pushes the fluid seal away from the outlet opening and the deflector to its outward position thereby enabling the water to travel through the sprinkler head and to be dispersed by the deflector.

In side wall mounted sprinklers, however, the ejection of trigger assembly may slow the release of the deflector from within the housing of the flush sprinkler assembly. Additionally, the orientation of assembly causes the pressurized water to disperse in a horizontal direction. While attempts have been made to redirect the flow of the water downwardly by adding a blade to the deflector, heretofore these side wall sprinklers have not produced an optimal spray pattern. Nor are they suitable for flush mounted arrangements since they do not permit the deflector to be fully recessed within the sprinkler head base. Consequently, there is a need for a flush side wall sprinkler assembly which offers improved ejection of the trigger assembly from the sprinkler head assembly when the trigger is activated. Furthermore, there is a need for an automatic side wall sprinkler assembly which exhibits an optimized spray pattern.

SUMMARY OF THE INVENTION

The present invention provides a flush side wall sprinkler assembly which includes an improved deflector and trigger assembly. The deflector assembly optimizes the dispersion of the water as it flows from the outlet by directing the flow of water outwardly and downwardly from the sprinkler head assembly when the sprinkler assembly is exposed to temperatures associated with a fire. The trigger assembly includes an ejector mechanism which improves the ejection of the trigger assembly from the sprinkler head assembly.

According to one form of the invention, a side wall sprinkler assembly includes a sprinkler body, a deflector, a closure member, and a trigger assembly. The deflector includes a pair of blades which are positioned on a common side from a central axis of the deflector. The closure member seals the outlet opening of the sprinkler body. The trigger assembly urges the closure member to sealingly engage the sprinkler body to close the outlet opening. Upon detecting a temperature associated with a fire, the trigger assembly releases the closure member whereby the pressurized fluid moves the closure off the outlet opening moves the deflector to the extended position.

In one aspect, the deflector includes a pair of upwardly extending arms, with the blades extending between the upwardly extending arms. In preferred form, the pair of blades are generally parallel.

In other aspects, the deflector is movably mounted to the body for generally horizontal movement. The deflector is movable between a retracted position wherein the deflector is recessed within the body and an extended position wherein the deflector is spaced from the outlet opening for dispersing the pressurized fluid which flows from the outlet opening.

According to another form of the invention, an automatic side wall sprinkler assembly includes a sprinkler body, a deflector, a closure member, and a trigger assembly. The deflector is movably mounted to the body for generally horizontal movement between a retracted position wherein at least a portion of the deflector is recessed within a cavity of the sprinkler head body and an extended position wherein the deflector is spaced from an outlet opening of the sprinkler head body for dispersing pressurized fluid which flows from the outlet opening. The deflector includes a pair of generally horizontal deflecting surfaces which are positioned and spaced from and generally parallel to a direction of flow of the fluid from the outlet opening for directing the flow of fluid outwardly and downwardly from the sprinkler assembly. The closure member is positioned between the deflector and the outlet opening for sealing the outlet opening. The trigger assembly applies a biasing force to urge the deflector in the retracted position and to urge the closure member to sealingly engage the sprinkler body to thereby close the outlet opening. Upon detecting a temperature associated with a fire, the trigger assembly releases the biasing force on the deflector and the closure member whereby the pressurized fluid moves the closure member off the outlet opening and moves the deflector to the extended position.

In one aspect, the trigger assembly includes a heat sensitive assembly and a spring assembly. The heat sensitive assembly has a pair of elements which are interconnected by heat fusible material which melts upon detecting a temperature associated with a fire. The spring assembly biases the deflector toward the retracted position and further urges the elements to separate when the heat fusible material is melted. Upon separating the elements, however, the spring releases the bias on the deflector. For example, the elements of the heat sensitive assembly may comprise plates.

In another aspects, the sprinkler assembly includes an ejector member for urging the trigger assembly to eject from the sprinkler head when the heat fusible material melts. For example, the spring assembly may include a pair of levers, with the ejector member being positioned between the levers and the deflector assembly to eject the levers from the sprinkler body when the heat sensitive assembly is triggered. In further aspects, the spring assembly further includes a lever support and a set screw, with the lever support being positioned between the levers and the ejector member and the set screw providing a biasing force to bias the deflector in the retracted position.

In other aspects, the ejector member is coupled to the lever support. For example, in one form the ejector member may include a pair of arms which releasably engage the lever support.

In another form of the invention, a side wall sprinkler assembly includes a sprinkler body, a deflector, a closure member, and a trigger assembly. The sprinkler body has a passage which extends through the body and defines an inlet opening and an outlet opening. The inlet opening communicates with a pressurized supply of fire suppressant fluid for delivering the pressurized fluid through the passage to the outlet opening. The sprinkler body includes a cavity, with the outlet opening being positioned in the cavity. The deflector is movably mounted to the sprinkler head body by three pins and moves between a retracted position within the cavity during an inactive state and an extended position outside of the cavity during an active state. The closure member is positioned between the deflector and the outlet opening for sealing the outlet opening. The trigger assembly applies a biasing force to the closure member to close the outlet opening. Upon detecting a temperature associated with a fire the trigger assembly releases the biasing force whereby the pressurized fire suppressant fluid in the passage moves the closure member off the outlet opening and moves the deflector assembly to the extended position.

In yet another form of the invention, an automatic side wall sprinkler assembly includes a sprinkler body, a deflector, a closure member, and a trigger assembly. Similar to the other forms, the deflector is movably mounted to the sprinkler body between a retracted position wherein at least a portion of the deflector is recessed within a cavity of the sprinkler body and an extended position wherein the deflector is spaced from an outlet opening of the sprinkler body for dispersing pressurized fluid which flows from the outlet opening. The closure member is positioned between the deflector and the outlet opening for sealing the outlet opening. The trigger assembly applies a biasing force to urge the deflector in the retracted position and to urge the closure member to sealingly engage the sprinkler body to thereby close the outlet opening. Upon detecting a temperature associated with a fire, the trigger assembly releases the biasing force on the deflector and the seal whereby the pressurized fluid moves the seal off the outlet opening and moves the deflector to the extended position.

In preferred form, the trigger assembly includes a heat sensitive assembly and a spring assembly. The heat sensitive assembly has a pair of elements which are interconnected by heat fusible material, which melts upon detecting of a temperature associated with a fire. The spring assembly applies a bias to urge the deflector toward the retracted position and urges the elements to separate when the heat fusible material melts. In further aspects, the trigger assembly includes an ejector member. When the spring assembly releases the bias on the deflector, the ejector urges the spring assembly to eject outwardly from the sprinkler head body.

These and other advantages, benefits, and objects will be understood by one skilled in the art from the drawings, descriptions, and claims which follow.

DESCRIPTION OF THE PREFERRED EMBODIMENTS

Figure 1:
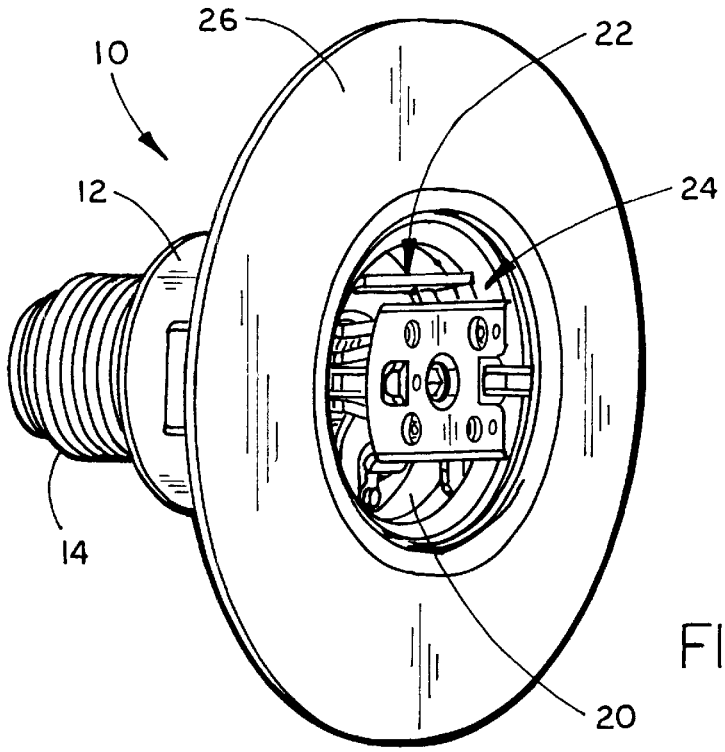
FIG. 1 is a perspective view of a flush sprinkler head assembly of the present invention.

Referring to FIG. 1, the numeral 10 generally designates a flush sprinkler head assembly of the present invention especially suitable for side wall mounting. Sprinkler head assembly 10 mounts in an opening 11 provided in a side wall S and includes an improved movable deflector assembly 22 (FIG. 3) and trigger assembly 24 (FIG. 3) which results in a quicker response when the sprinkler is exposed to a temperature of a preselected value which is associated with a fire and an improved trajectory of a fire extinguishing fluid, for example water. Henceforth, reference will be made to water as the fire extinguishing fluid, but it will be understood by those skilled in the art that other fire extinguishing fluids or fire suppressants may be used.

Figure 2:
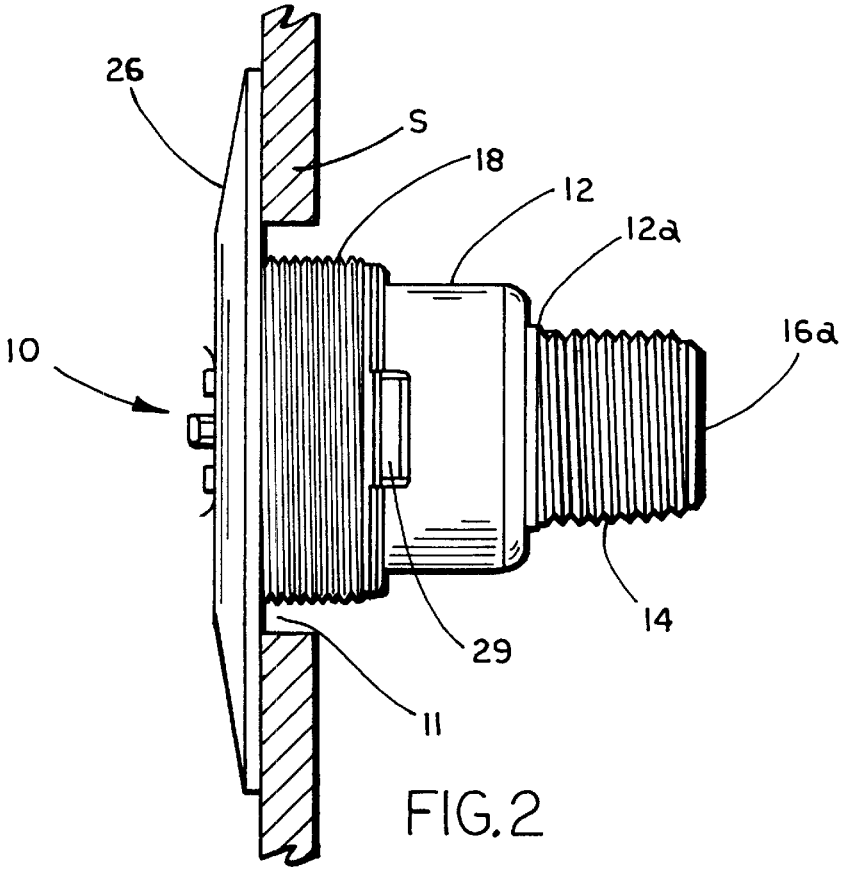
FIG. 2 is a side view of the flush sprinkler head assembly of FIG. 1 mounted in an opening of a side wall.
Figure 3:
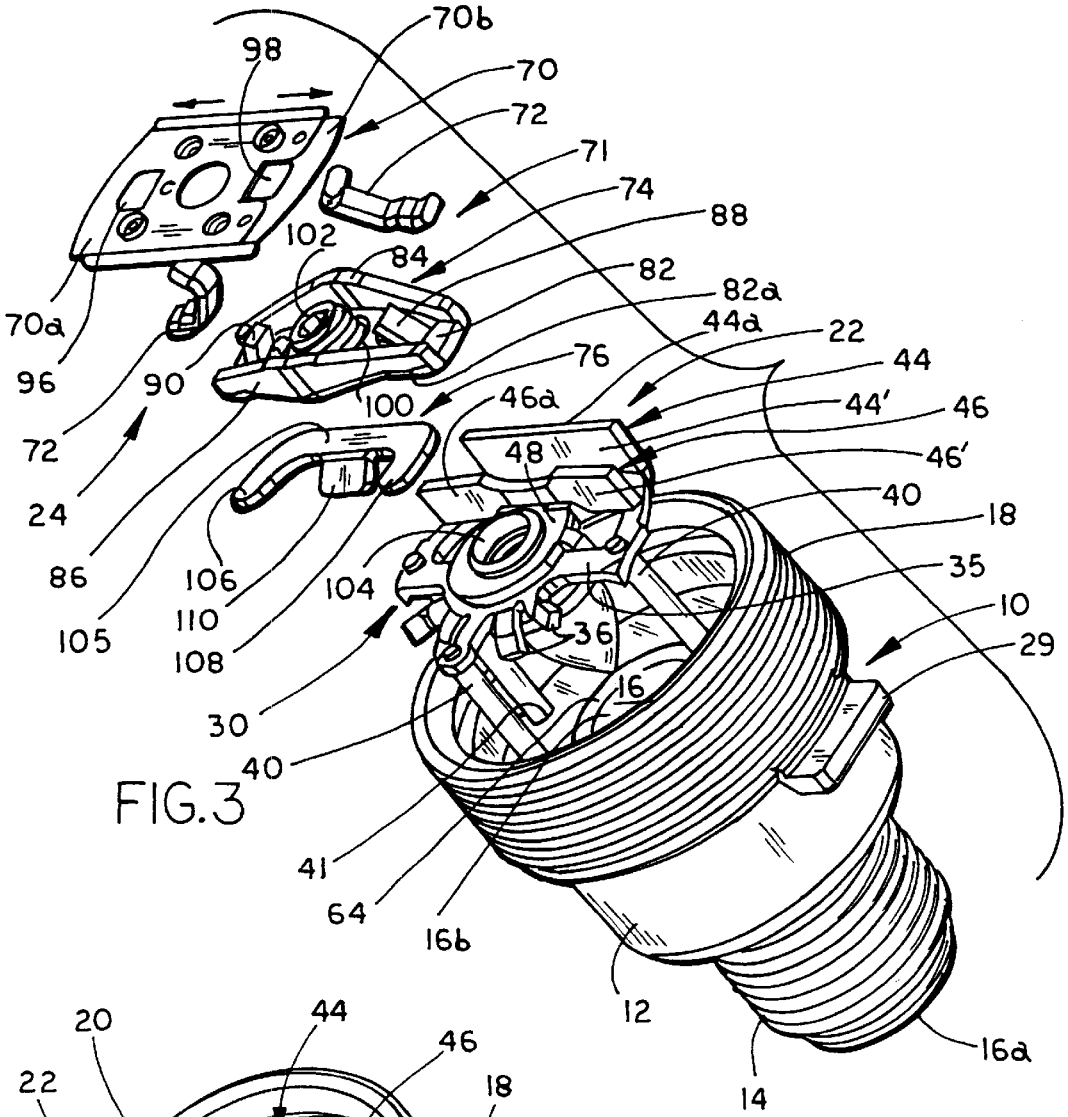
FIG. 3 is an exploded perspective view of the sprinkler head assembly of FIG. 1 with the cover removed.
Figure 4:
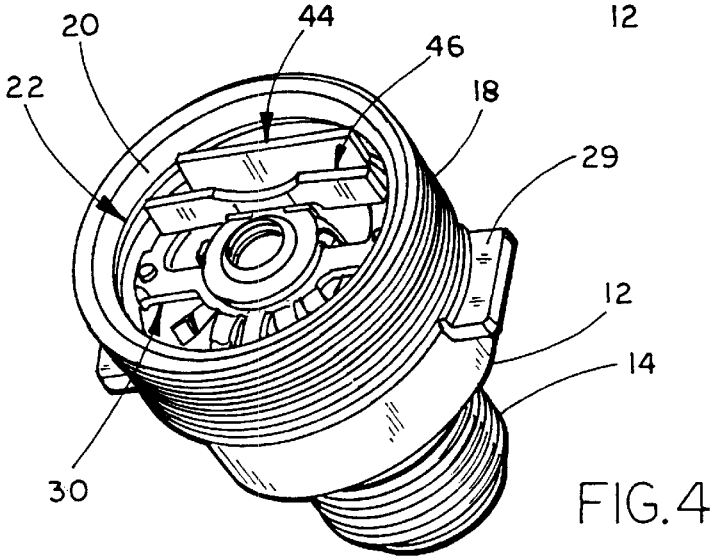
FIG. 4 is a rotated perspective view of the sprinkler head assembly of FIG. 3 with the deflector assembly in a retracted position.
Figure 5:
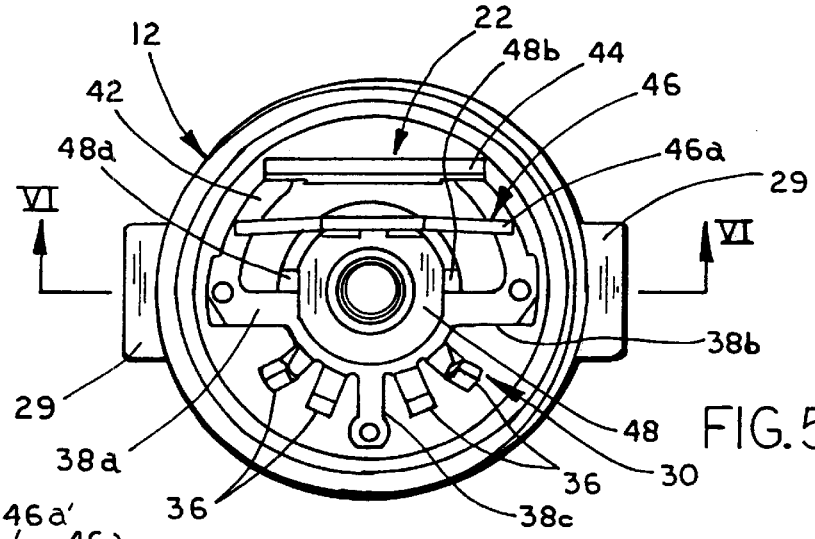
FIG. 5 is a front elevation view of the sprinkler head of FIG. 4.
Figure 6:
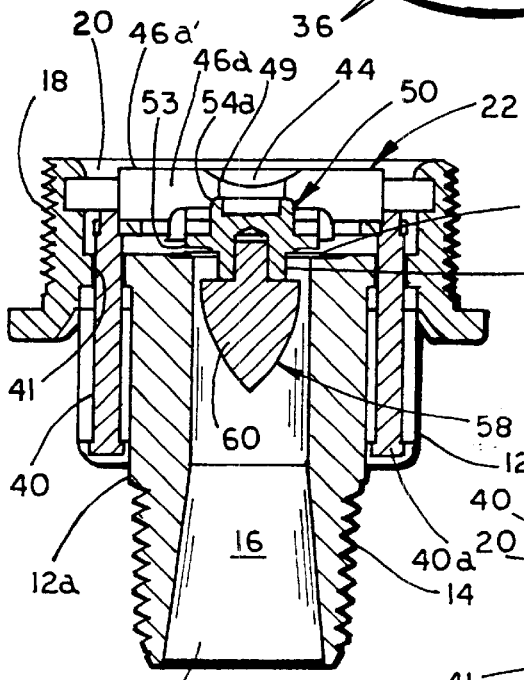
FIG. 6 is a cross-sectional view taken along line VI—VI of FIG. 5.
Figure 7:
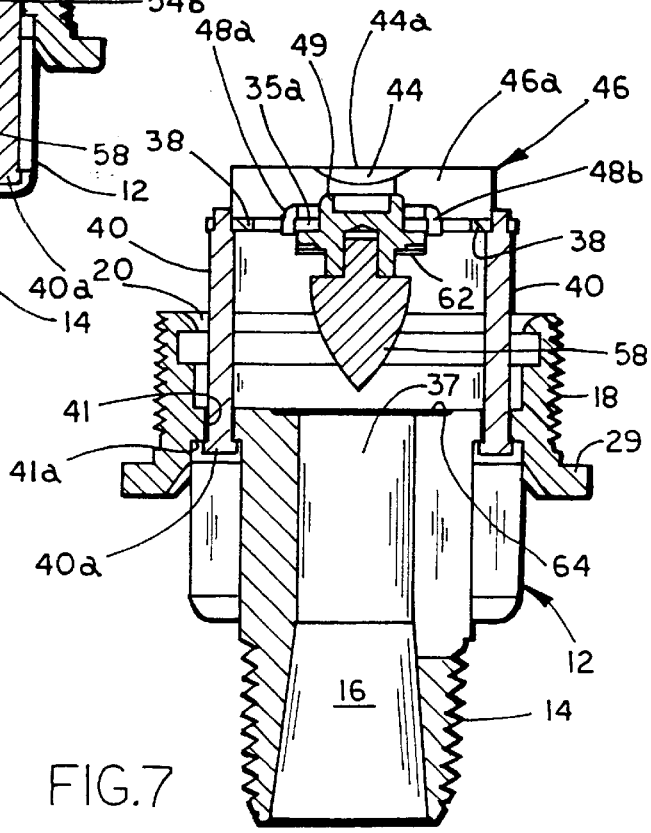
FIG. 7 is a similar cross-sectional view to FIG. 6 with the deflector assembly moved to its extended position.

Referring to FIG. 2, sprinkler head assembly 10 includes a housing 12 and a sprinkler head body 12*a* to which housing 12 is mounted, for example by welding or other suitable means. Housing 12 and sprinkler head body 12*a* are preferably metal components and, more preferably, brass components. Sprinkler head body 12*a* includes a first threaded portion 14 for coupling to a pressurized water supply system and a second threaded portion 18 which defines a cavity 20 for housing deflector assembly 22 and trigger assembly 24 (FIG. 3). Body 12*a* further includes a transverse passage 16 which extends through body 12*a* and defines an inlet opening 16*a* at first threaded portion 14 and an outlet opening 16*b* recessed in cavity 20 (FIGS. 6 and 7). Deflector assembly 22 and trigger assembly 24 are mounted to sprinkler head body 12*a* and recessed within cavity 20 during a non-activated state, as will be more fully described below. Mounted to threaded portion 18 is a cover 26 which threadingly engages threaded portion 18. Cover 26 provides a mounting flange and conceals opening 11 when sprinkler head assembly is mounted to side wall S. Preferably, body 12*a* also includes a pair of mounting members or tabs 29 which abut against the inner surface of side wall S (FIG. 2). Thus, when cover 26 is threaded on to threaded portion 18, sidewall S is compressed between tabs 29 and cover 26 to secure sprinkler head assembly 10 in place.

Referring to FIGS. 3–11, deflector assembly 22 is movably mounted to sprinkler head body 12*a* along a horizontal axis and includes a deflector 30. Similar to housing 12 and 274 body 12*a*, deflector assembly 22 is preferably a metal assembly, with deflector 30 preferably comprising a brass deflector. When sprinkler head assembly 10 is installed, deflector 30 moves generally horizontally between a retracted or inactive position within cavity 20 in which deflector 30 is preferably completely contained or recessed in cavity 20 and an extended or active position in which deflector 30 is spaced from outlet opening 16*b* to disperse the water which flows from outlet opening 16*b*. Deflector 30 includes a body 35 with a plurality of radially of extending legs or arms 36 which disperse the water and alter the trajectory of the water as it flows from outlet opening 16*b* when deflector 30 is moved to its extended position. Also projecting outwardly from body 35 of deflector 30 are a pair of radial mounting arms 38*a*, 38*b*, and 38*c* (FIGS. 5 and 8) to which a corresponding plurality of guide pins 40 are mounted for movably mounting deflector 30 to body 12*a* of sprinkler assembly 10. In preferred form, deflector 30 is movably mounted to body 12*a* by at least three guide pins in order to provide increased support and stability of deflector 30. As best seen in FIGS. 6 and 7, guide pins 40 extend into respective passages 41 formed in body 12*a* and include stops 40*a* to limit their movement through passages 41 from the fully retracted position wherein deflector assembly 22 is fully recessed in cavity 20 to the fully extended position wherein deflector 30 is spaced from outlet opening 16*b*.

Figure 8:
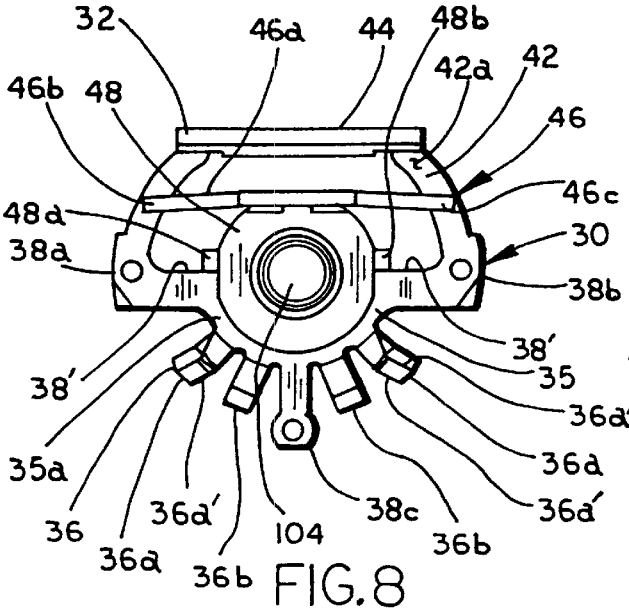
FIG. 8 is a plan view of the deflector assembly of the sprinkler head assembly of FIG. 1.
Figure 9:
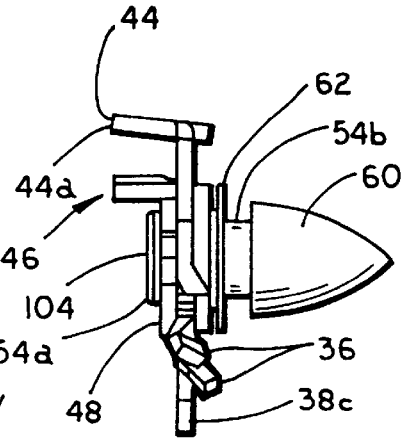
FIG. 9 is a side view of the deflector assembly of FIG. 8.
Figure 11:
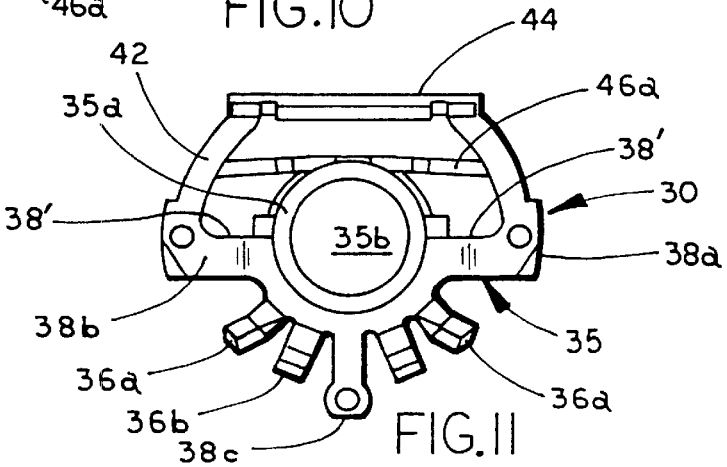
FIG. 11 is a rear elevation view of the deflector assembly of FIG. 8.

As best seen in FIGS. 8 and 11, radially projecting arms 38*a* and 38*b* are interconnected by a semi-annular support member 42. Support member 42 includes a pair of arms 43*a* and 43*b*, which extend upwardly from arms 38*a* and 38*b* when sprinkler head assembly 10 is installed, and a first blade member 44 which projects outwardly from arms 43*a* and 43*b*, away from outlet opening 16*b*. Blade member 44 includes a deflecting surface 44' which is spaced from the outlet opening 16 and is oriented generally parallel to the longitudinal or central axis 16*c* of passage 16 to direct the flow of water outwardly and downwardly from outlet opening 16*b*. Furthermore, blade member 44 is preferably spaced from and oriented generally parallel to arms 38*a* and 38*b*. In the illustrated embodiment, blade member 44 is generally rectangular and preferably includes a straight free edge 44*a* and a rearwardly projecting portion 44*b* which extends toward outlet opening 16*b* to improve the downward deflection of the water; however, it should be understood that blade member 44 can have other shapes and/or configurations to produce a similar downward redirection of the water from the outlet opening. In preferred form, blade member 44 is formed from a segment of support member 42 which is rotated, for example by stamping, to a position generally parallel direction to the flow of water in passage 16. In addition, blade 44 is sized to permit deflector assembly 22 to be fully recessed within sprinkler head body 12*a*. In this manner, when water flows from outlet opening 16*a* and is initially dispersed in a radial manner, as will be more fully described below, the water will impinge on deflector surface 44' and be redirected downward from sprinkler assembly 10. Supported on body 35 is a second blade member 46 which includes a deflection surface 46' for similarly redirecting the flow of water from outlet opening 16*b* outwardly and downwardly. Together with projecting arms 36, blade members 44 and 46 alter the trajectory of the water as it flows out of outlet opening 16*b* in a generally outwardly and downwardly direction which is particularly desirable in a side wall mounting application.

Figure 10:
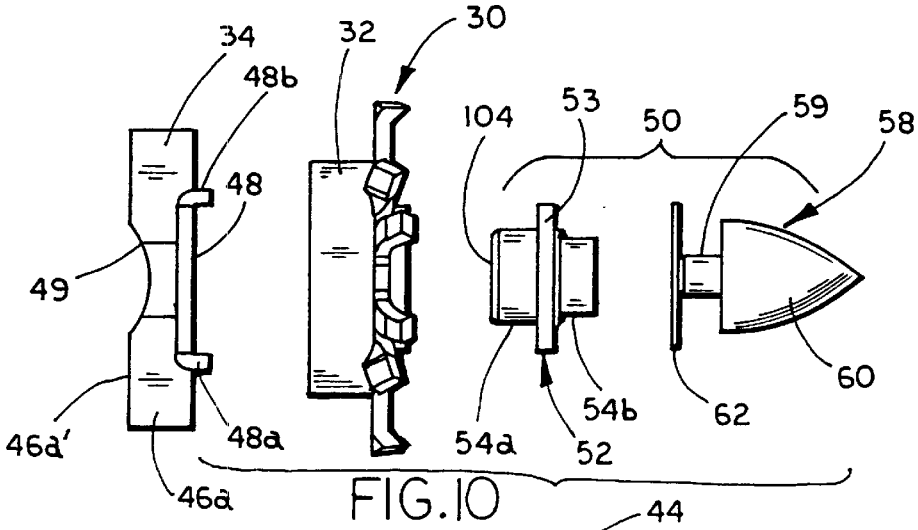
FIG. 10 is an exploded side view of the deflector assembly of FIG. 8.

Referring to FIGS. 8, 10, and 11, blade member 46 includes a blade element 46*a* and a mounting portion 48 for mounting blade member onto deflector 30. Mounting portion 48 preferably includes a pair of locating members 46*a* and 46*b* which straddle a central portion 35*a* of body 35 and abut upper sides 38' of radially extending legs 38*a* and 38*b*. When mounted to body 35, mounting portion 48 positions blade element 46*a* of blade member 46 spaced from longitudinal axis 16*c* and in a generally parallel orientation to the direction of flow of fluid from outlet 16*b* similar to blade member 44 and, further, is preferably spaced from axis 16*c* on the same side as blade member 44. In preferred form, blade element 46*a* includes a generally rectangular body which defines deflecting surface 46' and which includes a radiused notch or central cut-out portion 49 at its free edge 46*a'* (FIG. 10) and, further, is sized to permit deflector assembly 22 to be fully recessed within sprinkler head body 12*a*. When mounted to central portion 35*a* of deflector body 35, end portions 46*b* and 46*c* of blade member 46 extend over support member 42 of deflector 30. Preferably, when seated on body 35, blade member 46 extends between arms 43*a* and 43*b*, and positioning members 46*a* and 46*b* align blade element 46*a* generally parallel to and spaced from blade member 44 so that together blade members 44 and 46 redirect the flow of water outwardly and downwardly from sprinkler assembly 10.

As best seen in FIGS. 8–11, projecting legs 36 of deflector 30 are bent and twisted in a manner to disperse or divert the flow of water from the outlet opening 16*b* in a generally radial pattern so that sprinkler assembly 10 will disperse water over a large area and yet provide sufficient coverage to extinguish a fire. Preferably, outermost projecting members 36*a* are twisted about their respective longitudinal axes such that their inner edges 36*a'* are twisted into the plane defined by body 35 whereas outer edges 36*a* ' are twisted to project out of the plane defined by body 35. Inner projecting legs 36*b* are bent into the plane defined by body 35 as viewed in FIGS. 5 and 8. It should be understood to those skilled in the art that the number of legs 36 can be increased or decreased as desired and, further, that legs 36 can be arranged in many different configurations. The preferred form is for illustrative purposes only.

Referring again to FIG. 11, central portion 35*a* of body 35 includes a central circular opening 35*b*. Positioned in opening 35*b* is a spring and button assembly 50 (FIG. 10). When mounted to body 12*a*, spring and button assembly 50 extends rearwardly of deflector 30 toward outlet opening 16*b*. Referring again to FIG. 10, spring and button assembly 50 comprises a mounting base 52 which includes an annular flange 53 and a projecting mounting member 54*a*. Projecting mounting member 54*a* extends into and through opening 35*b* (FIG. 11) of deflector body 35. Extending from an opposed side of flange 53 is a second projecting mounting member or collar 54*b*, in which a button assembly 58 is positioned. Button assembly 58 includes a shaft 59, which extends into collar 54*b*, and a bullet-shaped button body 60. Slidably mounted on collar 54*b* is an annular spring sealing or closure member 62, which seals outlet opening 16*b* of sprinkler head assembly 10 when deflector assembly 22 is retracted into cavity in its closed position as shown in (FIGS. 13 and 14).

Figure 14:
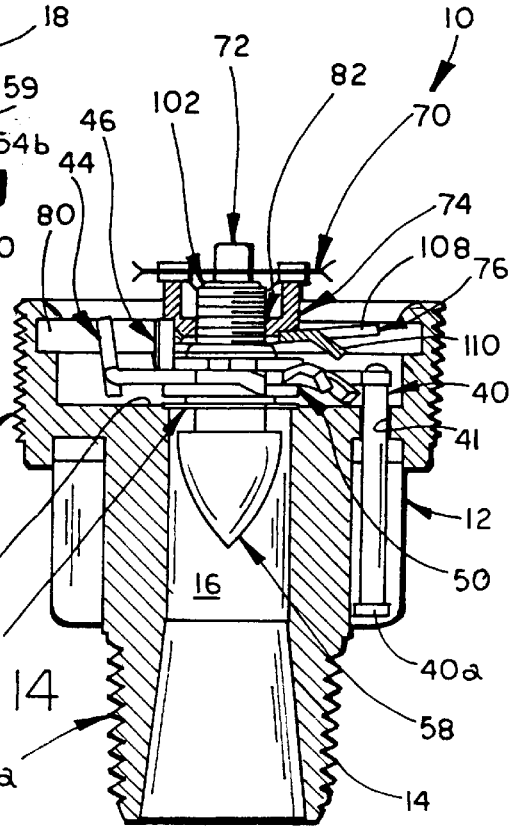
FIG. 14 is a partial cross-sectional view taken along line XIV—XIV of FIG. 12.

As best understood from FIGS. 6 and 14, when deflector assembly 22 is in its closed position, button body 60 extends through outlet opening 16*b* and is positioned in passage 16. In addition, spring sealing or closure member 62 is positioned over outlet opening 16*b* and positioned on an annular sealing surface 64 provided on sprinkler head body 12*a* which extends around or circumscribes outlet opening 16*b*. As will be described in greater detail in reference to trigger assembly 24, when in the unactivated state, deflector assembly 22 is biased toward body 12*a* in cavity 20 and spring sealing member 62 sealingly engages annular sealing surface 64 thereby closing outlet opening 16*b*. However, when trigger assembly 24 is activated to open by exposure to temperatures associated with a fire, deflector assembly 22 being no longer biased towards body 12*a* moves to its extended position with deflector 30 spaced from outlet opening 16*b* under the force of the water pressure of the water in passage 16. The water pressure pushes on spring sealing member 62 and the rearward side of deflector 30 to push deflector assembly 30 to its extended position until stops 40*a* of guide pins 40 engage bearing surface 41*a* of body 12*a*. The initial water pressure from outlet opening 16*b* is increased by button body 60, which restricts the initial flow of water from passage 16 through outlet opening 16*b*. However, once deflector assembly 22 is in its fully extended position and button body 60 is fully removed from passage 16, rather than restricting the flow of water button body 60 provides an initial dispersion of the water flowing from outlet opening 16*b*. Once in the extended position, deflector 30 further disperses the flow of water from outlet opening 16*b* with arms 36 and blades 44 and 46 dispersing and directing the flow of water generally downward (as viewed in FIGS. 3–5).

As previously described, deflector assembly 22 is biased in its non-activated or retracted position by trigger assembly 24. Referring again to FIG. 3, trigger assembly 24 includes a fusible plate assembly 70, a pair of levers or arms 72, and a lever support and guide member 74. Fusible plate assembly 70 includes a first fusible plate member 70*a* and a second fusible plate member 70*b* which are joined by heat fusible or heat sensitive material. Heat fusible materials are generally known in the automatic sprinkler industry and is generally recognized as a material used in the art possessing the requisite degree of bonding strength and thermal sensitivity such that when the fusible plate assembly 70 is exposed to temperatures associated with a fire the heat fusible material melts releasing the connection between plates 70*a* and 70*b*.

Figure 12:
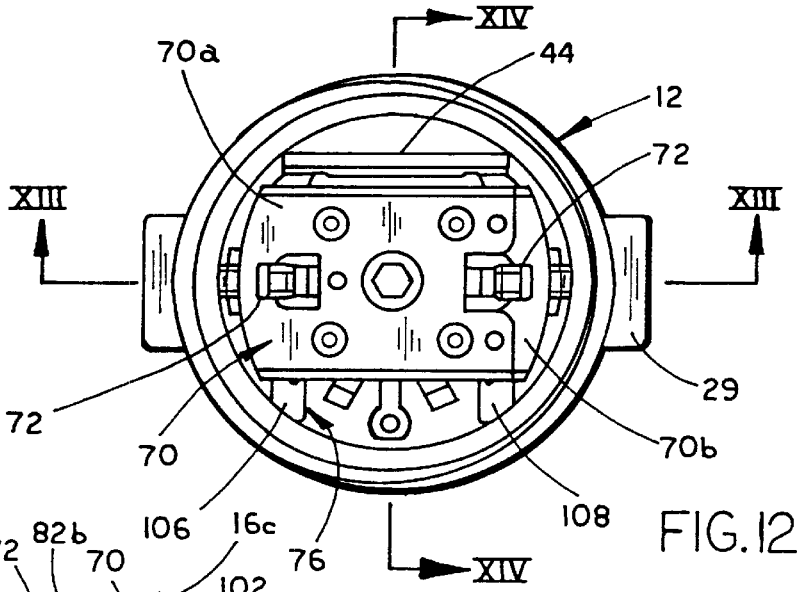
FIG. 12 is a front elevation view of the sprinkler head assembly of FIG. 3 with the deflector assembly and fusible link in a non-activated state.
Figure 13:
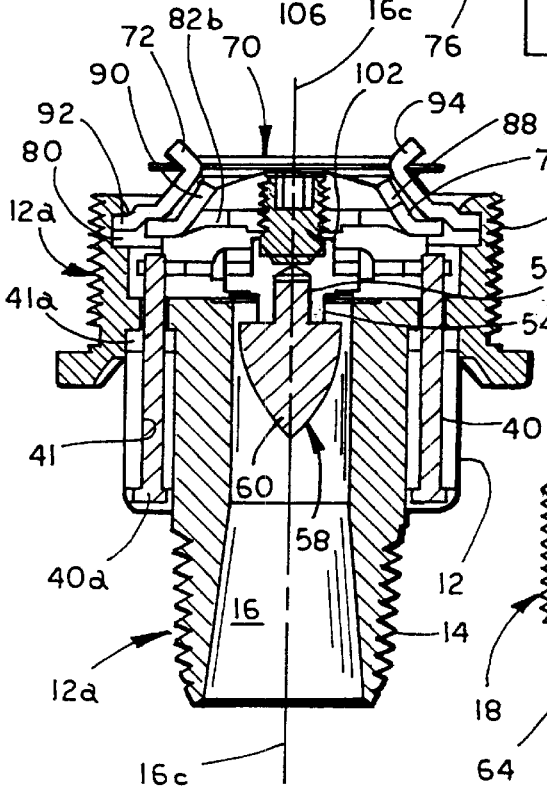
FIG. 13 is a cross-sectional view taken along line XIII—XIII of FIG. 12.

Referring to FIGS. 12–14, trigger assembly 24 is mounted to sprinkler assembly 10 by a spring assembly 71. Spring assembly 71 includes a pair of levers 72, lever support 74, and an ejector 76. Levers 72 are supported by lever support 74 and extend into an annular groove 80 formed an inner surface of second threaded portion 18 in cavity 20 to releasably mount trigger assembly 24 to sprinkler head body 12*a*. As best seen in FIG. 13, each lever 72 includes a groove en gaging portion 92 for engaging groove 80 and fusible link engaging portion 94 for engaging fusible plate assembly 70. Fusible link engaging portions 94 of levers 72 extend through apertures 96 and 98 which are provided in plate members 70*a* and 70*b*, respectively. Together groove engaging portion 92 and fusible link engaging portion 94 form a generally inverted L-shaped cross-section which will provide a biased lever type action more fully described below.

Lever support 74 is positioned beneath levers 72 and biases levers 72 outwardly from cavity 20. As best seen in FIG. 3, lever support 74 is generally channel-shaped and includes a webbed portion 82 and a pair of opposed flanges 84 and 86 which define side walls. Extending upwardly from web portion 82 are a pair of lever support members 88 and 90 which are preferably punched out from web portion 82 to define openings 82*b*. As shown in FIG. 13, lever support members 88 and 90 provide support for levers 72 when trigger assembly 24 is mounted to groove 80 of sprinkler head body 12*a*. Lever support 74 further includes a central opening 100 in web portion 82 which is threaded for receiving a threaded set screw 102. Referring again to FIG. 13, when groove engaging portions 92 of levers 72 are positioned in groove 80 and fusible link engaging portions 94 are extended through apertures 96 and 98, set screw 102 is tightened such that distal end 102*a* of set screw extends into a pocket 104 provided on button and seal mounting member 54*a* . In this manner, sealing member 62 is biased against sealing surface 64 to cover and seal outlet opening 16*b*. In addition, levers 72 are biased outwardly from sprinkler head 12*a* by the force of set screw 102 on lever support 74 as it bears against seal and button mounting member 54*a* and lever support 74 pushes on levers 72. As best seen in FIG. 13, support members 88 and 90 contact levers 72 inwardly of groove engaging portions 92 and inwardly of fusible link engaging portions 94 which causes levers 72 to apply a tension force to fusible plate members 70*a* and 70*b* in the direction of the arrows shown in FIG. 3. Thus, when fusible link 70 is exposed to temperatures associated with fires and the fusible material between plate members 70*a* and 70*b* melts, levers 72 will urge plates 70*a* and 70*b* to separate in the directions indicated by the arrows in FIG. 3, and will further rotate about groove engaging portions 92 and to disengage from groove 80.

To improve the injection of levers 72 and lever support 74 from sprinkler head body 12, ejector member 76 is positioned beneath lever support 74, between lever support 74 and deflector assembly 22. In the illustrated embodiment shown in FIG. 3, ejector member 76 preferably comprises an "E" shape member with a base 105 and two outer leg portions 106 and 108. Leg portions 106 and 108 are generally aligned in a common plane with base 105. A middle leg portion 10 of ejector member 76 is bent inwardly from legs 106 and 108 toward deflector assembly 22 (FIGS. 3 and 14). When trigger assembly 24 is mounted to sprinkler head body 12*a*, ejector member 76 is positioned between lever support 74 and deflector assembly 22, with legs 106 and 108 of ejector member 76 engaging groove 80. Further, ejector member 76 is positioned such that body 105 is positioned beneath the lower side 82*a* of web 82. In this manner, when sprinkler head assembly 10 is exposed to temperatures associated with a fire and the fusible material between plates 70*a* and 70*b* melt, levers 72 will urge plates 70*a* and 70*b* to separate along the line of direction shown in FIG. 3 and ejector member 76 will pivot about legs 106 and 108 to urge lever support 74 and levers 72 to eject outwardly from sprinkler head body 12*a*. As a result, trigger assembly 24 is quickly ejected from the path of the deflector assembly 22, and deflector assembly is quickly moved to its extended position under the pressure of the water.

Figure 15:
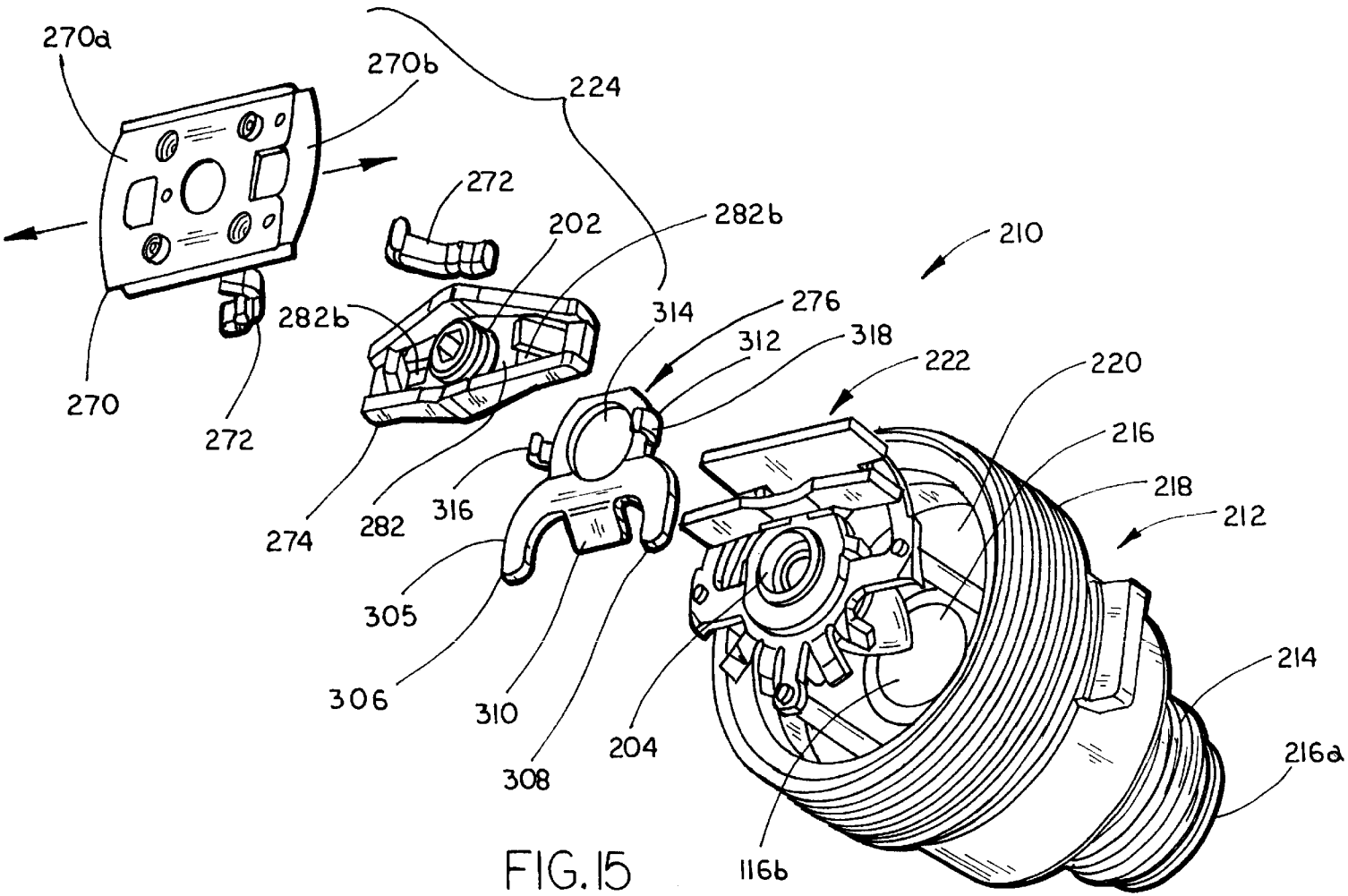
FIG. 15 is an exploded view of an alternate embodiment of the sprinkler head assembly of the present invention.

Referring to FIG. 15, a second embodiment of sprinkler assembly 210 is illustrated. Sprinkler 210 is of similar construction to the previous embodiment and includes a base 212, with threaded portions 214 and 218, and a transverse passage 216 which defines an inlet opening 216*a* on one end of base 212 and an outlet opening 216*b*.

Similar to the previous embodiment, sprinkler 210 includes a deflector assembly 222 and a trigger assembly 224, which includes an ejector member 276 to improve the ejection of trigger assembly 224 and, more particularly, of levers 272 and lever support 274 when heat sensitive assembly 270 is triggered.

Ejector member 276 includes an E-shaped portion 305, with outer leg portions 306 and 308 and a medial leg portion 310, similar to the previous embodiment. In addition, ejector member 276 includes a connector portion 312 which includes a central opening 314 to permit set screw 202 of lever support 274 to engage recessed opening 204 of deflector assembly 222 in a similar manner to set screw 102 of the previous embodiment. Positioned on opposed sides of the central opening 314 are a pair of arms 316 and 318 which extend through openings 282*b* of base portion 282 of lever support 274 and are preferably bent to provide a snap fit coupling between ejector member 276 and lever support 274. In this manner, when heat sensitive assembly 270 is triggered by exposure to temperatures associated with a fire, and the fusible members 270*a* and 270*b* are decoupled, levers 272 urge fusible members 270*a* and 270*b* to separate along the line of direction indicated by the arrows in FIG. 15. Once separated, the pressure of the set screw 202 on the deflector assembly 222 is released, thus permitting deflector assembly 222 under the pressure of the water from outlet opening 216*b* to move from its retracted position within cavity 220 to an extended position which urges ejector member 276 to pivot about legs 306 and 308. Ejector member 276 in turn urges lever support 274 and levers 272 to eject outwardly from sprinkler head body 212.

It should be understood that the foregoing is a description of the preferred embodiments. Those skilled in the art will recognize that variations, modifications, and improvements may be made with out departing from the spirit or scope of the invention disclosed herein. For example, a person of having ordinary skill in the art will readily understand that other trigger or fusible links or spring assemblies may be used with this sprinkler head assembly and, further, that sprinkler heads having varying internal components which differ from those depicted in FIGS. 6, 7, 13, and 14 may employ the improved deflector assembly, trigger assembly, and/or ejector of the present invention. In addition, the overall shape of the ejector member and blade members may be varied to achieve a similar effect. For example, the ejector member and lever support may be formed as a single member with the ejector member arms being formed, for example, as part of the lever support base portion. Furthermore, the deflector assembly (22 or 222) may include a single blade member or more than two blade members. Consequently, the scope of protection afforded the present invention is to be measured by the claims which follow in the breadth of interpretation which the law allows.

The embodiments of the invention in which we claim exclusive property or privilege are defined as follows:

1. A side wall sprinkler assembly comprising:

a sprinkler body having a passage extending therethrough defining an inlet opening and an outlet opening, said inlet opening for communicating with a pressurized source of fluid, said sprinkler body including a cavity, and said outlet opening being recessed in said sprinkler body in said cavity;

a deflector mounted to said sprinkler body, said deflector including a central axis and a pair of blades disposed on a common side from said central axis of said deflector;

a closure member for sealing said outlet opening; and a trigger assembly urging said closure member in sealing engagement with said body to close said outlet opening, upon detecting a temperature associated with a fire said trigger assembly releasing said closure member whereby the pressurized fluid moves said closure member off said outlet opening.

2. The side wall sprinkler assembly according to claim 1, wherein said deflector includes a pair of upwardly extending arms, said pair of blades extending between said arms.

3. The side wall sprinkler assembly according to claim 1, wherein said pair of blades comprise a first blade and a second blade, said first blade being spaced from and generally parallel to said second blade.

4. A side wall sprinkler assembly comprising:

a sprinkler body having a passage extending therethrough defining an inlet opening and an outlet opening, said inlet opening for communicating with a pressurized source of fluid, said sprinkler body including a cavity, and said outlet opening being recessed in said sprinkler body in said cavity;

a deflector mounted to said sprinkler body, said deflector including a central axis and a pair of blades disposed on a common side from said central axis of said deflector, said deflector being movably mounted to said body for generally horizontal movement, and said deflector being movable between a retracted position wherein said deflector, including said pair of blades, are recessed within said cavity and an extended position wherein said deflector is spaced frown said outlet opening for dispersing the pressurized fluid flowing from said outlet opening;

a closure member for sealing said outlet opening; and a trigger assembly urging said closure member in sealing engagement with said body to close said outlet opening, upon detecting a temperature associated with a fire said trigger assembly releasing said closure member whereby the pressurized fluid moves said closure member off said outlet opening.

5. The side wall sprinkler assembly according to claim 3, wherein said first blade is spaced radially inward from said second blade.

6. The side wall sprinkler assembly according to claim 5, wherein said first blade includes a free edge and an arcuate cut-out at said free edge.

7. The side wall sprinkler assembly according to claim 5, wherein said second blade includes a downwardly depending portion which extends toward said outlet opening for further deflecting the pressurized water from said outlet opening.

8. An automatic side wall sprinkler assembly comprising:

a sprinkler body adapted to mount at a side wall, said sprinkler body having a passage extending therethrough defining an inlet opening and an outlet opening, said inlet opening for communicating with a pressurized source of fluid, said sprinkler body including a cavity, and said outlet opening being positioned in said cavity;

a deflector movably mounted to said body and being movable generally horizontally between a retracted position wherein at least a portion of said deflector is recessed within said cavity and an extended position wherein said deflector is spaced from said outlet opening for dispersing the pressurized fluid which flows from said outlet opening, said deflector including at least a pair of horizontal deflecting surfaces positioned spaced from and generally parallel to a direction of flow of the fluid from said outlet opening for directing the flow of fluid outwardly and downwardly from said sprinkler assembly, said horizontal deflecting surfaces being at least partially recessed in said cavity when said deflector is moved to said retracted position;

a closure member positioned between said deflector and said outlet opening for sealing said outlet opening; and a trigger assembly applying a biasing force to said deflector to urge said deflector in said retracted position and to urge said closure member to sealingly engage said sprinkler body to thereby close said outlet opening, upon detecting a temperature associated with a fire said trigger assembly releasing said biasing force whereby the pressurized fluid moves said closure member off said outlet opening and moves said deflector to said extended position.

9. The automatic side wall sprinkler assembly according to claim 8, wherein said deflector includes a pair of blades defining said pair of deflecting surfaces.

10. The automatic side wall sprinkler assembly according to claim 9, wherein said deflector further includes a pair of upwardly extending arms, said pair of blades extending between said arms.

11. The automatic side wall sprinkler assembly according to claim 9, wherein each of said pair of blades includes a horizontal extent, each of said horizontal extents of said blades being sufficiently short to permit said blades to be fully recessed within said cavity of said sprinkler body when said deflector is in said retracted position.

12. The automatic side wall sprinkler assembly according to claim 11, wherein said horizontal extents of said blades are substantially similar.

13. The automatic side wall sprinkler assembly according to claim 8, wherein said trigger assembly includes a heat sensitive assembly and a spring assembly, said heat sensitive assembly having a pair of elements being interconnected by heat fusible material, said heat fusible material melting upon detection of temperatures associates with a fire, said spring assembly applying a bias to urge said deflector toward said retracted position and urging said elements to separate when said heat fusible material melts, and said spring assembly releasing said bias when said heat fusible material melts.

14. The automatic side wall sprinkler assembly according to claim 13, wherein said elements of said heat sensitive assembly comprise plate members.

15. The automatic side wall sprinkler assembly according to claim 13, further comprising an ejector member, said ejector member urging said trigger assembly to eject from said sprinkler head when said heat fusible material melts.

16. The automatic side wall sprinkler assembly according to claim 15, wherein said spring assembly further includes a pair of levers, said ejector member being positioned between said levers and said deflector assembly.

17. The automatic side wall sprinkler assembly according to claim 8, wherein said deflector includes a plurality of radially extending arms for dispersing the fluid flow from said outlet opening in a generally radial pattern, said deflecting surfaces being generally orthogonal to at least one of said radially extending arms.

18. The automatic side wall sprinkler assembly according to claim 8, further comprising a deflector body, said deflector body being supported by said deflector and extending into said outlet opening and into said passage for initially increasing the pressure of the pressurized fluid at said outlet opening when said trigger assembly releases said biasing force on said deflector.

19. An automatic side wall sprinkler assembly comprising:

a sprinkler body having a passage extending therethrough defining an inlet opening and an outlet opening, said inlet opening for communicating with a pressurized source of fluid, said sprinkler body including a cavity, and said outlet opening being positioned in said cavity;

a deflector movably mounted to said body and being movable generally horizontally between a retracted position wherein at least a portion of said deflector is recessed within said cavity and an extended position wherein said deflector is spaced from said outlet opening for dispersing the pressurized fluid which flows from said outlet opening, said deflector including at least a pair of horizontal deflecting surfaces positioned spaced from and generally parallel to a direction of flow of the fluid from said outlet opening for directing the flow of fluid outwardly and downwardly from said sprinkler assembly;

a closure member positioned between said deflector and said outlet opening for sealing said outlet opening;

a trigger assembly applying a biasing force to said deflector to urge said deflector in said retracted position and to urge said closure member to sealingly engage said sprinkler body to thereby close said outlet opening, upon detecting a temperature associated with a fire said trigger assembly releasing said biasing force whereby the pressurized fluid moves said closure member off said outlet opening and moves said deflector to said extended position, said trigger assembly including a heat sensitive assembly and a spring assembly, said heat sensitive assembly having a pair of elements being interconnected by heat fusible material, said heat fusible material melting upon detection of temperatures associates with a fire, said spring assembly applying said biasing force to urge said deflector toward said retracted position and urging said elements to separate when said heat fusible material melts, and said spring assembly releasing said biasing force when said heat fusible material melts; and an ejector member, said ejector member urging said trigger assembly to eject from said sprinkler head when said heat fusible material melts, said spring assembly including a pair of levers, said ejector member being positioned between said levers and said deflector assembly, and said spring assembly further including a lever support and a set screw, said lever support being positioned between said levers and said ejector member, and said set screw providing a biasing force co bias said deflector in said retracted position.

20. The automatic side wall sprinkler assembly according to claim 19, wherein said ejector member is coupled to said lever support.

21. An automatic side wall sprinkler assembly comprising:

a sprinkler body having a passage extending therethrough defining an inlet opening and an outlet opening, said inlet opening for communicating with a pressurized source of fluid, said sprinkler body including a cavity, and said outlet opening being recessed in said sprinkler body in said cavity;

a deflector movably mounted to said body and being movable generally horizontally between a retracted position wherein at least a portion of said deflector is recessed within said cavity and an extended position wherein said deflector is spaced from said outlet opening for dispersing the pressurized fluid which flows from said outlet opening;

a closure member positioned between said deflector and said outlet opening for sealing said outlet opening; and a trigger assembly applying a biasing force to said deflector to urge said deflector in said retracted position and to urge said closure member to close and seal said outlet opening, said trigger assembly including an ejector member, said ejector member comprising an E-shaped member, said E-shaped member having a pair of spaced apart arms engaging said sprinkler body and pivoting about said arms when the pressurized fluid moves said deflector toward said extended position, upon detecting a temperature associated with a fire said trigger assembly releasing said biasing force whereby the pressurized fluid moves said closure member off said outlet opening and moves said deflector to said extended position to disperse the pressurized fluid flowing from said outlet opening, and said ejector member urging said trigger assembly to move outwardly from said sprinkler head body when said bigger assembly detects said temperature to improve the response of said sprinkler assembly.

22. The automatic side wall sprinkler assembly according to claim 21, wherein said sprinkler body includes a groove in said cavity, and said pair of arms of said ejector member engaging said groove and rotating about said groove urging said trigger assembly to eject outwardly from said sprinkler body when said heat fusible material melts and the pressurized fluid moves said deflector toward said extended position.

23. A side wall sprinkler assembly comprising:

a sprinkler body having a passage extending therethrough defining an inlet opening and an outlet opening, said inlet opening for communicating with a pressurized supply of fluid for delivering said pressurized fluid through said passage to said outlet opening, said sprinkler body defining a cavity, said outlet opening being positioned in said cavity, and said sprinkler body including a groove in said cavity;

a deflector movably mounted to said sprinkler body by three pins and moving generally horizontally between a retracted position within said cavity during an inactive state and an extended position outside of said cavity during an active state;

a closure member positioned over said outlet opening for sealing said outlet opening; and a trigger assembly applying a biasing force to said closure member to close said outlet opening, said closure member being position between said deflector and said outlet opening, said trigger assembly applying a biasing force to said deflector to urge said closure member to seal said outlet opening, upon detecting a temperature associated with a fire said trigger assembly releasing said biasing force whereby the pressurized fluid in said passage move said closure member off said outlet opening and moves said deflector to said extended position, said trigger assembly including an ejector member, and said ejector member engaging said groove and rotating about said groove outwardly from said body and urging said trigger assembly to eject from said sprinkler head the pressurized fluid moves said deflector toward said extended position.

24. The side wall sprinkler assembly according to claim 23, wherein said trigger assembly includes a pair of levers and a heat sensitive member, said heat sensitive member comprising two elements interconnected by heat fusible material, and said levers urging said elements to separate when said heat fusible material melts.

25. The side wall sprinkler assembly according to claim 24, wherein said ejector member comprises an E-shaped member.

26. A side wall sprinkler assembly comprising:

a sprinkler body having a passage extending therethrough defining an inlet opening and an outlet opening, said inlet opening for communicating with a pressurized source of fluid, said sprinkler body including a cavity, and said outlet opening being recessed in said sprinkler body in said cavity;

a deflector movably mounted to said and being movable generally horizontally between a retracted position wherein at least a portion of said deflector is recessed within said cavity and an extended position wherein said deflector is spaced from said outlet opening for dispersing the pressurized fluid which flows from said outlet opening;

a closure member positioned over said opening for sealing said outlet opening; and a trigger assembly applying a biasing force to said closure member to close and seal said outlet opening, upon detecting a temperature associated with said fire said trigger assembly releasing said biasing force whereby the pressurized fluid moves said closure member off said outlet opening and moves said deflector to said extended position to disperse pressurized fluid flowing from said outlet opening, said trigger assembly including an ejector member, said ejector member comprising an E-shaped member, said E-shaped member including a pair of spaced apart arms engaging said sprinkler body and pivoting about said when the pressurized fluid moves said deflector toward said extended position, and said ejector member urging said trigger assembly to move outwardly from said sprinkler head body when the pressurized fluid moves said deflector assembly toward said extended position.

27. The side wall sprinkler according to claim 26, wherein said sprinkler body includes a groove in said cavity, said pair of said arms engaging said groove in said cavity and rotating about said groove outwardly from said body when the pressurized fluid moves said deflector assembly toward said extended position.

28. A side wall sprinkler assembly comprising:

a sprinkler body having a passage extending therethrough defining an inlet opening and an outlet opening, said inlet opening for communicating with a pressurized source of fluid, said sprinkler body including a cavity, and said outlet opening being recessed in said sprinkler body in said cavity;

deflector movably mounted to said body and being movable generally horizontally between a retracted position wherein at least a portion of said deflector is recessed within said cavity and an extended position wherein said deflector is spaced from said outlet opening for dispersing the pressurized fluid which flows from said outlet opening;

a closure member positioned over said outlet opening for sealing said outlet opening; and a trigger assembly applying a biasing force to said closure member to close and seal said outlet opening, upon detecting a temperature associated with said fire said trigger assembly releasing said biasing force whereby the pressurized fluid moves said closure member off said outlet opening and moves said deflector to said extended position to disperse pressurized fluid flowing from said outlet opening, said trigger assembly including an ejector member, said ejector member urging said trigger assembly to move outwardly from said sprinkler head body when the pressurized fluid moves said deflector assembly toward said extended position, said trigger assembly further including a heat sensitive assembly and a spring assembly, said spring, assembly including a pair of levers and a lever support, and said ejector member urging said levers and said lever support to move outwardly from said sprinkler body when the pressurized fluid moves said deflector assembly toward said extended position.

29. The side wall sprinkler according to claim 28, wherein said ejector member is coupled to said lever support.

30. The side wall sprinkler assembly according to claim 29, wherein said ejector member is releasably coupled to said lever support.

* * * * *

UNITED STATES PATENT AND TRADEMARK OFFICE

CERTIFICATE OF CORRECTION

PATENT NO. : 6,367,559 B1
DATED : April 9, 2001
INVENTOR(S) : Thomas E. Winebrenner It is certified that error appears in the above-identified patent and that said Letters Patent is hereby corrected as shown below:

Column 5,
Line 33, delete “274” before “body”

Column 6,
Lines 33 and 51, “46a” should be -- 48a --
Lines 34 and 51, “46b” should be -- 48b --

Column 8,
Line 12, “en gaging” should be -- engaging --
Line 63, “10” should be -- 110 --

Column 10,
Line 47, “frown” should be -- from --

Column 12,
Line 64, “co” should be -- to --

Column 13,
Line 34, “bigger” should be -- trigger --
Line 63, “position” should be -- positioned --

Column 14,
Line 3, “move” should be -- moves --
Line 9, insert -- when -- after “head”
Line 27, insert -- body -- after “said”
Line 34, insert -- outlet -- after “said”
Line 47, insert -- arms -- after “said”
Line 66, insert -- a -- before “deflector”

UNITED STATES PATENT AND TRADEMARK OFFICE

CERTIFICATE OF CORRECTION

PATENT NO. : 6,367,559 B1
DATED : April 9, 2001
INVENTOR(S) : Thomas E. Winebrenner It is certified that error appears in the above-identified patent and that said Letters Patent is hereby corrected as shown below:

Column 16,
Line 4, delete "," after "spring" in the second occurrence

Signed and Sealed this

Second Day of November, 2004

JON W. DUDAS
*Director of the United States Patent and Trademark Office*